US010392803B2

(12) United States Patent
Charest et al.

(10) Patent No.: US 10,392,803 B2
(45) Date of Patent: Aug. 27, 2019

(54) COMPOSITE I-TRUSS

(71) Applicant: 9306-1695 QUéBEC INC., Chicoutimi (CA)

(72) Inventors: Yvan Charest, Chicoutimi (CA); Paul Girard, Latierriere (CA); Yves Ouellet, Canton Tremblay (CA)

(73) Assignee: 9306-1695 QUÉBEC INC., Chicoutimi (CA)

( * ) Notice: Subject to any disclaimer, the term of this patent is extended or adjusted under 35 U.S.C. 154(b) by 0 days.

(21) Appl. No.: 15/744,934

(22) PCT Filed: Jul. 12, 2016

(86) PCT No.: PCT/CA2016/050820
§ 371 (c)(1),
(2) Date: Jan. 15, 2018

(87) PCT Pub. No.: WO2017/008158
PCT Pub. Date: Jan. 19, 2017

(65) Prior Publication Data

US 2018/0202162 A1 Jul. 19, 2018

Related U.S. Application Data

(60) Provisional application No. 62/191,759, filed on Jul. 13, 2015.

(51) Int. Cl.
*E04C 3/292* (2006.01)
*E01D 6/00* (2006.01)
(Continued)

(52) U.S. Cl.
CPC ..... *E04C 3/292* (2013.01); *E01D 6/00* (2013.01); *E04B 7/022* (2013.01); *E04C 3/291* (2013.01); *E01D 19/10* (2013.01)

(58) Field of Classification Search
CPC ..... E04C 3/292; E04C 3/291; E04B 7/022; E04D 19/10; E01D 6/00
See application file for complete search history.

(56) References Cited

U.S. PATENT DOCUMENTS 1,994 A * 2/1841 Price et al. ..... E04C 3/02 52/695
1,377,891 A * 5/1921 Knight ..... E04C 3/122 52/841
(Continued)

FOREIGN PATENT DOCUMENTS

CA 1302221 C 6/1992
CA 2102228 A1 10/1992
(Continued)

OTHER PUBLICATIONS

Canadian Intellectual Property Office; International Search Report; dated Sep. 26, 2016.
(Continued)

*Primary Examiner* — James M Ference
(74) *Attorney, Agent, or Firm* — Price Heneveld LLP

(57) ABSTRACT

A composite I-truss is provided, that comprises a pair of top and bottom flanges and an extending intermediate web having a first end secured to the first flange and a second end secured to the second flange. Each flange comprises one or more longitudinal beams secured to the flange connectors. The web comprises at least a pair of flange connectors extending away from the flange and toward the web. The web comprises a plurality of linking struts located at a plurality of longitudinal positions along a length of the I-truss and connecting the flange connectors of the first flange to the flange connectors of the second flange.

18 Claims, 17 Drawing Sheets

(51) Int. Cl.

| | |
|---|---|
| ***E04B 7/02*** | (2006.01) |
| ***E04C 3/29*** | (2006.01) |
| *E01D 19/10* | (2006.01) |

(56) References Cited

U.S. PATENT DOCUMENTS 1,918,346 A * 7/1933 McHose ..... E04C 3/08 403/267
2,024,001 A * 12/1935 Hamilton ..... E01D 6/00 14/14
2,514,607 A * 7/1950 McLean ..... E01D 6/00 52/692
2,860,743 A * 11/1958 Cliff ..... E04C 3/08 403/230
2,902,951 A * 9/1959 Maag ..... E04C 3/292 403/188
3,137,899 A * 6/1964 Troutner ..... E04C 3/07 52/693
3,268,251 A * 8/1966 Troutner ..... E04C 3/07 403/190
3,330,087 A * 7/1967 Troutner ..... E04C 3/07 403/217
3,386,222 A * 6/1968 Troutner ..... E04C 3/07 52/693
3,397,502 A * 8/1968 Simpson, Jr. ..... E04C 3/07 52/376
3,422,591 A * 1/1969 Troutner ..... E04C 3/292 403/384
3,531,903 A * 10/1970 Swanson ..... E04C 3/292 256/24
3,537,224 A * 11/1970 Troutner ..... E04C 3/292 403/217
3,570,204 A * 3/1971 Birkemier ..... E04C 3/292 52/289
3,778,946 A * 12/1973 Wood ..... E04C 3/18 29/446
3,857,218 A * 12/1974 Gilb ..... E04C 3/292 52/692
3,925,951 A * 12/1975 Jackson ..... E04C 3/292 403/217
3,946,532 A * 3/1976 Gilb ..... E04C 3/292 52/692
3,985,459 A * 10/1976 Gilb ..... E04B 1/49 403/217
4,007,573 A * 2/1977 Gilb ..... E04B 1/2608 403/188
4,069,635 A * 1/1978 Gilb ..... E04C 3/292 52/693
4,077,176 A * 3/1978 Bauer ..... E04C 3/292 52/692
4,195,462 A * 4/1980 Keller ..... E04C 3/14 52/690
4,274,241 A * 6/1981 Lindal ..... E04B 1/26 411/461
4,333,293 A * 6/1982 Jackson ..... E04C 3/292 52/692
4,336,678 A * 6/1982 Peters ..... B27M 3/0086 403/265
4,366,659 A * 1/1983 Jensen ..... E04C 3/292 411/466
4,372,093 A * 2/1983 Ericsson ..... E04C 3/292 52/642
4,413,459 A * 11/1983 Lambuth ..... E04C 3/127 52/837
4,416,102 A * 11/1983 Peters ..... E04C 3/292 52/692
4,456,497 A * 6/1984 Eberle ..... B27M 3/0026 144/352
4,476,663 A * 10/1984 Bikales ..... B27B 1/005 144/350
4,548,014 A * 10/1985 Knowles ..... E04C 3/09 52/693
4,648,216 A * 3/1987 Reaves ..... E04B 1/26 52/639
4,730,431 A * 3/1988 Ericsson ..... E04C 3/292 52/376
4,890,437 A * 1/1990 Quaile ..... E04C 3/42 52/223.9
4,965,973 A * 10/1990 Engebretsen ..... E04C 3/14 52/223.8
5,006,390 A * 4/1991 Kavesh ..... B29C 70/10 428/105
5,026,593 A * 6/1991 O'Brien ..... B32B 15/10 428/215
5,350,265 A * 9/1994 Kinner ..... E04B 1/0007 411/160
5,422,556 A 6/1995 Graf et al.
5,567,535 A * 10/1996 Pettit ..... B29C 70/088 428/608
5,592,800 A * 1/1997 Koo ..... E04C 3/292 52/692
5,704,185 A * 1/1998 Lindsay ..... E04C 3/291 403/175
5,867,963 A * 2/1999 Hershey ..... E04C 3/16 52/650.2
5,974,760 A * 11/1999 Tingley ..... B29C 70/025 52/837
6,173,550 B1 * 1/2001 Tingley ..... B29C 70/025 52/837
6,363,682 B1 * 4/2002 Cowley ..... E04C 3/18 52/842
6,571,527 B1 * 6/2003 Rattini ..... E04C 3/08 52/692
6,598,847 B2 * 7/2003 Doucet ..... B65D 71/0092 108/56.3
6,758,022 B1 * 7/2004 Coll ..... E04C 3/09 52/638
6,993,881 B1 * 2/2006 Ruble ..... E04C 3/08 14/13
7,073,298 B1 * 7/2006 Phan ..... E04B 5/02 52/223.6
7,140,158 B2 * 11/2006 Steadman ..... E04C 3/08 52/694
7,356,974 B2 * 4/2008 Tadich ..... E04C 3/292 52/690
8,141,318 B2 * 3/2012 Dunbar ..... E04C 3/07 52/636
8,959,868 B2 * 2/2015 Robinson ..... E04C 3/08 403/408.1
2002/0020134 A1 * 2/2002 Collard ..... E04C 3/08 52/694
2006/0053732 A1 * 3/2006 Watson ..... E04C 3/09 52/693
2006/0075715 A1 * 4/2006 Serpico ..... E04B 1/24 52/648.1
2011/0000165 A1 * 1/2011 Glenn ..... E04C 3/08 52/692
2018/0202162 A1 * 7/2018 Charest ..... E01D 6/00

FOREIGN PATENT DOCUMENTS

| | | | |
|---|---|---|---|
| CA | 2133276 | C | 4/1995 |
| CA | 2184622 | A1 | 9/1995 |
| CA | 2193392 | A1 | 1/1996 |
| CA | 2188443 | A1 | 5/1996 |
| CA | 2215298 | A1 | 9/1996 |
| CA | 2278184 | A1 | 7/1998 |
| CA | 2312319 | A1 | 6/1999 |
| CA | 2226584 | A1 | 9/1999 |
| CA | 2305878 | A1 | 10/2001 |
| CA | 2391049 | A1 | 3/2002 |
| CA | 2492292 | A1 | 1/2004 |
| CA | 2483086 | A1 | 5/2005 |
| CA | 2713123 | A1 | 7/2009 |
| CA | 2713124 | A1 | 7/2009 |
| CA | 2675004 | A1 | 2/2010 |

(56) References Cited

FOREIGN PATENT DOCUMENTS

| | | | |
|---|---|---|---|
| CA | 2797195 | A1 | 11/2011 |
| WO | 198803211 | A1 | 5/1988 |

OTHER PUBLICATIONS

Mitek Holdings, Inc., "Posi-Strut Metal Web System", Copyright 2011-2013, http://www.mitek-us.com/connectors/posi-strut.aspx.
Wolf Systems Limited, "Wolf Systems' easi-joist—28% stronger than MiTek Industries Posi-Joist", Copyright 2014, https://www.wolfsystem.co.uk/company/news/2013/ussue-2/article-4.aspx.

* cited by examiner

COMPOSITE I-TRUSS

CROSS-REFERENCE TO RELATED APPLICATIONS

This application claims priority under 35 USC § 119(e) of U.S. Provisional Patent Application 62/191,759 filed on Jul. 13, 2015, the specification of which is hereby incorporated by reference. This application is a national phase entry of PCT Patent Application Serial Number PCT/CA2016/050820, filed on Jul. 12, 2016, (now pending) designating the United States of America.

TECHNICAL FIELD

The technical field generally relates to structural members and, more particularly, relates to a composite I-truss for use in various structures, such as bridges, platforms or roofings, etc. . . .

BACKGROUND

I-trusses, also called I-beams or joists, are used in a number of building and structural applications. These I-trusses include top and bottom flanges with intervening web members or boards joining the flanges. A number of composite I-truss have been designed and manufactured, and include a wide variety of structural components for which different materials may be used, such as, for example, wood, metal, concrete, fiberglass and mixtures thereof. In particular, the use of wood in the making of I-truss has the advantage of lowering manufacturing costs, as metal trusses can be expensive. Moreover, wood beams, studs, or parts are readily available.

There is a need for such I-truss capable of supporting enhanced loads such as in bridges, platforms or other structures of the like.

Moreover, short or medium span bridges or small structures are generally customized and handmade, which increases the time required for their assembly and makes them costly. There is a need for providing structural elements which can be readily assembled.

Hence, in light of the aforementioned, there is a need for an I-truss which, by virtue of its design and components, would be able to overcome, or at least minimize, some of the aforementioned prior art problems.

SUMMARY

It is therefore an aim of the present invention to address at least one of the above mentioned issues.

In a first aspect, the present invention therefore provides a composite I-truss comprising: a first longitudinally-extending flange; a second longitudinally-extending flange spaced apart from, and extending in a same truss plane as the first flange and defining therebetween a web portion; a web extending between and connecting the first flange and the second flange together, the web comprising a plurality of connecting elements, a first flange connector, a second flange connector, and a plurality of flange fastening assemblies, the first flange connector being secured to the first longitudinally-extending flange through a first set of the flange fastening assemblies extending through the first longitudinally-extending flange and the first flange connector, the second flange connector being secured to the second longitudinally-extending flange through a second set of the flange fastening assemblies extending through the second longitudinally-extending flange and the second flange connector, each one of the first and second flange connectors having a section protruding outwardly from a respective one of the first and second flanges in the web portion, the connecting elements being positioned longitudinally at a plurality of longitudinal positions along a length of the composite I-truss and having a first end secured to the first flange connector and a second end secured to the second flange connector.

In one embodiment, each one of the first and the second longitudinally-extending flanges comprises a longitudinal beam. In a further embodiment, at least one of the longitudinal beams comprises a plurality of longitudinally adjacent beam sections, adjacent ones of the beam sections having complementary end sections superposed to one another; and joining members superposed to the superposed end sections of the adjacent ones of the beam sections and secured thereto. In a further embodiment, at least one longitudinal beam comprises a wooden beam.

In one embodiment, each one of the first and the second flange connectors comprises a plurality of longitudinally spaced-apart flange connectors having a flange section secured to a respective one of the flange and a web section protruding outwardly from the respective one of the flanges and secured to a respective one of the first and the second ends of the connecting elements. Particularly, at least one of the first and the second longitudinally-extending flanges comprises two or more juxtaposed longitudinal beams and the flange section of the plurality of flange connectors comprises one of: a fixation plate comprising a flat body and at least one beam-facing surface, a L-shaped fixation member comprising a L-shaped body comprising two beam-facing surfaces, a T-shaped fixation member comprising a T-shaped body and three beam-facing surfaces, the respective flange section of the one of the plurality of flange connectors interposed between the two or more longitudinal beams. More particularly, the flange section of the plurality of flange connectors comprises one of: a channel member comprising a U-shaped body, and a closed sleeve, the respective flange section of the one of the plurality of flange connectors at least partially surrounding the one or more longitudinal beams. Still, particularly, the flange section of the fixation member extends between two longitudinal beams.

In one embodiment, the first and second ends of the connecting elements are secured to a corresponding one of the flange connectors. Particularly, each one of the plurality of connecting elements comprises a linking strut and the first and second ends of the linking struts are secured to the web section of a corresponding one of the first and the second flange connectors. More particularly, the plurality of linking struts comprises at least one normally-extending strut extending substantially normal to the first and second flanges, and at least one diagonally-extending strut defining an oblique angle with the first and second flanges, the at least one normally-extending strut and the at least one diagonally-extending strut being configured in an alternating configuration.

In a particular embodiment, consecutive ones of the first or the second ends of the at least one normally-extending strut and at least one end of the at least one diagonally-extending strut are configured in an adjacent configuration.

In one embodiment, each one of the first and second flange connectors further comprises a mounting element extending longitudinally along the respective one of the first and second flanges and being secured to the corresponding one of the flange connectors' web section. Alternatively, the first and the second flange connectors and the plurality of connecting elements of the web are single piece, with the connecting elements extending continuously between the first and the second flange connectors. Particularly, the first and the second flange connectors and the connecting elements are made of metal. More particularly, the metal comprises aluminum.

According to one embodiment, the first and the second flanges are parallel.

According to one embodiment, flange section of the beam connectors comprises a plurality of apertures to receive a respective one of the fastening assemblies therein. In a further embodiment, the fastening assemblies further comprise at least one bolt extending radially from a beam-facing surface of the: fixation plate, L-shaped member or T-shaped member, the bolt insertable in an aperture of the beam.

In one embodiment, the flange fastening assemblies comprise bolts extending through a respective one of the first and the second flanges and a respective one of the first and the second flange connectors and nuts engaged with the bolts, outwardly of the respective one of the first and the second flanges and the respective ones of the first and the second flange connectors. Furthermore, the first and second flanges comprise a recess defined therein and the flange fastening assemblies further comprise a shear ring inserted in the recess, the shear ring surroundings one of the bolts. In a further embodiment, the flange fastening assemblies further comprise an inner sleeve inserted in a respective one of the first and the second flanges and surrounding a corresponding one of the bolts extending therethrough. Alternatively, the fastening assemblies comprise an inner shear ring inserted in a respective one of an inner side the first and the second flanges and surrounding a corresponding one of the bolts extending therethrough, and an outer shear ring inserted in a respective one of an outer side the first and the second flanges and surrounding a corresponding one of the bolts extending therethrough. In accordance with a particular embodiment, the sleeve and the shear ring are single piece and surround a corresponding one of the bolts. In a second aspect, the present invention provides a bridge comprising a plurality of composite I-truss as defined herein, wherein the plurality of I-truss is positioned horizontally and transversal to a direction of traffic of the bridge, the plurality of I-truss being supported and connected to vertical beams by assembling elements. As used herein, the term bridge defines any bridge, footbridge, catwalk or passageway that allows the passage of traffic. Particularly, the bridge further comprises a flat platform covering the plurality of composite I-trusses, for allowing traffic to pass therethrough. The traffic may comprise motorized vehicle(s), non-motorized vehicles or pedestrians. In a particular embodiment of this aspect, the bridge further comprises at least two guard fences located on both of sides of the bridge.

In a further aspect, the present invention therefore provides a web kit for assembling a first flange and a second flange to form an I-truss as defined herein, comprising: a first flange connector having a flange section securable to the first flange and a web section protruding from the first flange when secured thereto; a second flange connector having a flange section securable to the second flange and a web section protruding from the second flange when secured thereto; and a plurality of connecting elements, each one of the connecting elements having a first end securable to the web section of the first flange connector and a second end securable to the web section of the second flange connector. According to one embodiment, the web kit further comprises a plurality of flange fastening assemblies for securing a respective one of the first and the second flanges to a respective one of the first and the second flange connectors; or for securing an end of a respective one of the connecting element to a respective one of the first and the second flange connectors.

In a further embodiment, the present invention provides the web kit for assembling the I-truss as defined herein, wherein the connecting elements and the first and the second flange connectors are preassembled to define a web lattice.

In a further embodiment, the connecting elements of the web kit comprise linking struts, and the first and the second flange connectors comprises one of: fixation plates, L-shaped members, T-shaped members, U-shaped brackets and sleeve brackets.

In an alternative embodiment of the web kit, the web section of each one of the first and the second flange connectors further comprises a bolt being secured to a flange-facing surface of the flange section of the first or the second flange connectors.

According to a further aspect, the invention provides a method for assembling the composite I-truss as defined herein, comprising the step of: mounting each one of the first and the second ends of the connector elements to a respective one of the first and the second flange connectors to form a web lattice and mounting the first flange connector to the first flange and the second flange connector to the second flange.

In a further aspect, the present invention provides a web subassembly for a composite I-truss having a first flange and a second flange, the web subassembly comprising a single piece web lattice including a first flange connector, a second flange connector spaced-apart from the first flange connector, and a plurality of longitudinally spaced-apart connecting elements extending between the first and the second flange connectors, each one of the first and second flange connectors having a flange section securable to a corresponding one of the first and the second flanges.

According to a further aspect, the invention provides a flange connector for a composite I-truss as defined herein, the flange connector comprising a body having at least one flange-facing surface and a bolt extending outwardly of the flange-facing surface, the bolt being insertable in a beam for assembly thereof. The objects, advantages and other features of the present invention will become more apparent upon reading of the following non-restrictive description of its optional embodiments, which is given for illustrative purposes only, with reference to the accompanying drawings.

DETAILED DESCRIPTION

In the following description, the same numerical references refer to similar elements. Furthermore, for sake of simplicity and clarity, namely so as to not unduly burden the figures with several reference numbers, not all figures contain references to all the components and features described herein and references to some components and features may be found in only one figure, and components and features illustrated in other figures can be easily inferred therefrom. The embodiments, geometrical configurations, materials mentioned and/or dimensions shown in the figures are optional, and are provided for illustrative purposes only.

Composite I-Truss

In addition, although the optional embodiments described herein and as illustrated in the accompanying drawings comprises various components, and although they may consist of certain geometrical configurations as explained and illustrated herein, not all of these components and geometries are essential and thus should not be taken in their restrictive sense, i.e. should not be taken as to limit the scope of the present disclosure. It is to be understood that other suitable components and cooperation therebetween, as well as other suitable geometrical configurations may be used for the composite I-truss, as briefly explained and as can be easily inferred herefrom, without departing from the scope of the disclosure.

Broadly described, the invention relates to a composite I-truss that comprises first and second flanges and a web having a first portion secured to the first flange and a second portion secured to the second flange.

It will be readily understood that the terms I-truss or I-beam are non-restrictive and may be replaced with terms known to be equivalent by a person skilled in the art, such as open web joist, for example. Similarly, the term flange may be replaced with the term chord or equivalent terms. The term "composite" is used herein to refer to I-truss or I-beams or other elements composed of two or more materials.

Figure 1:
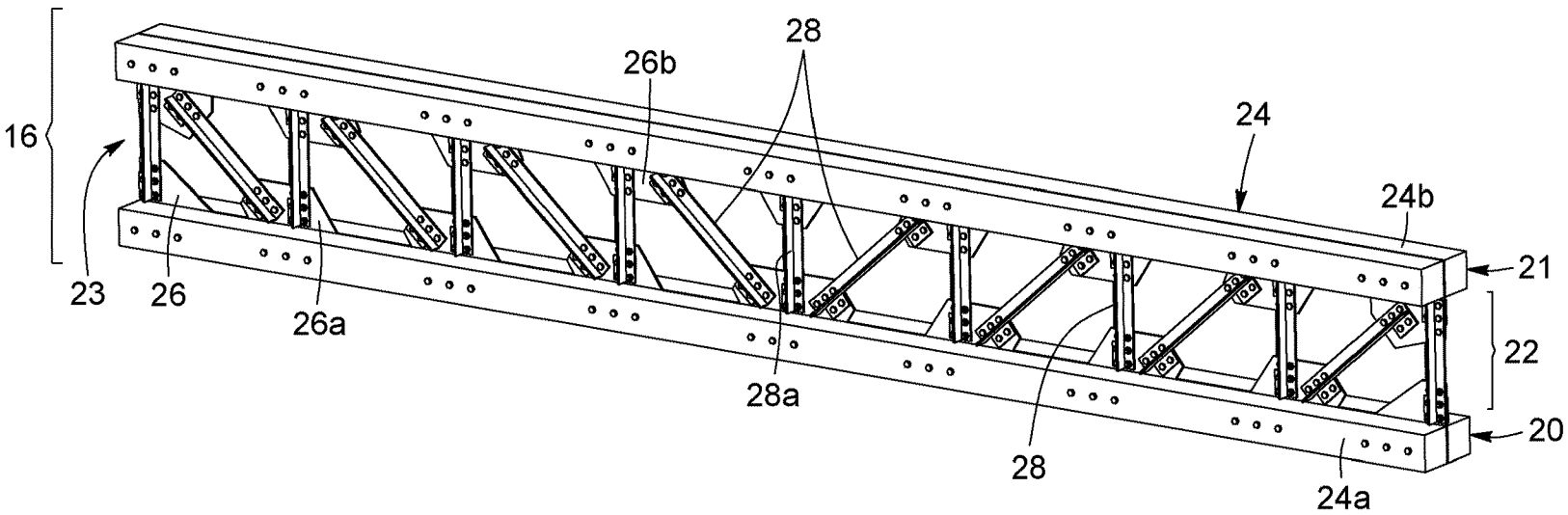
FIG. 1 is a perspective view of a composite I-truss according to an embodiment.
Figure 3:
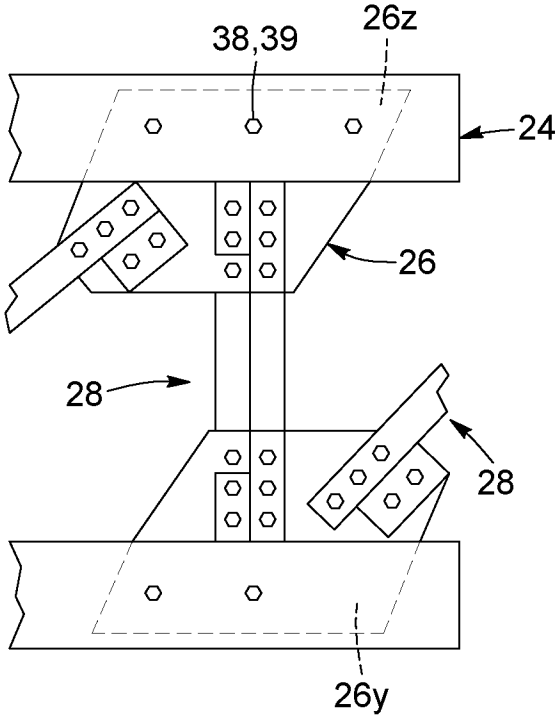
FIG. 3 is a front elevation view, enlarged, of the composite I-truss shown in FIG. 1.
Figure 2:
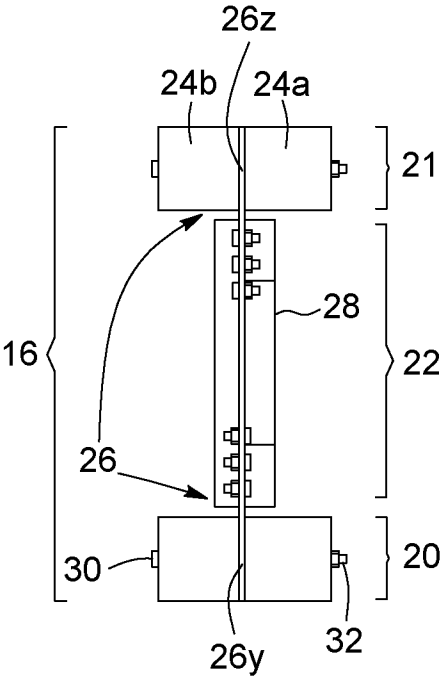
FIG. 2 is a side elevation view of the composite I-truss shown in FIG. 1.
Figure 20:
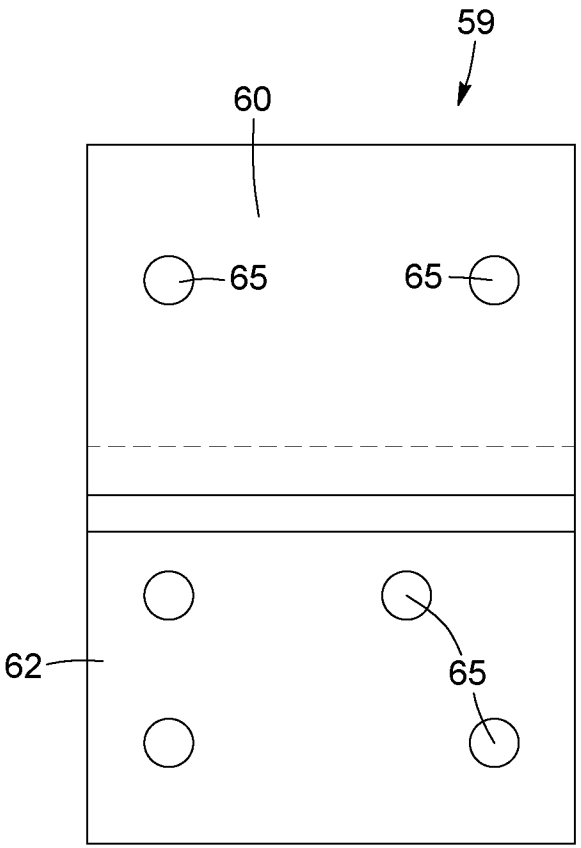
FIG. 20 is a side elevation view of a flange connector including a U-shaped bracket from FIG. 19.
Figure 19:
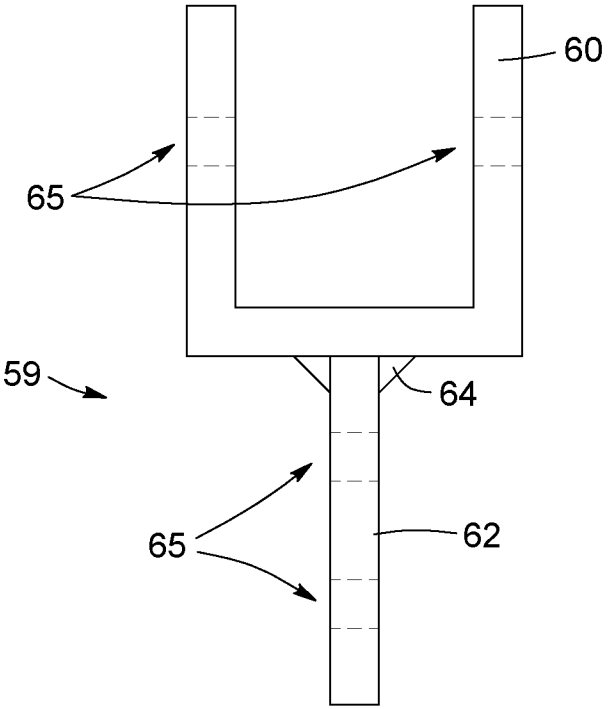
FIG. 19 is a front elevation view of a flange connector including a U-shaped bracket for connecting with a longitudinally-extending flange of a composite I-truss according to an embodiment.
Figure 22:
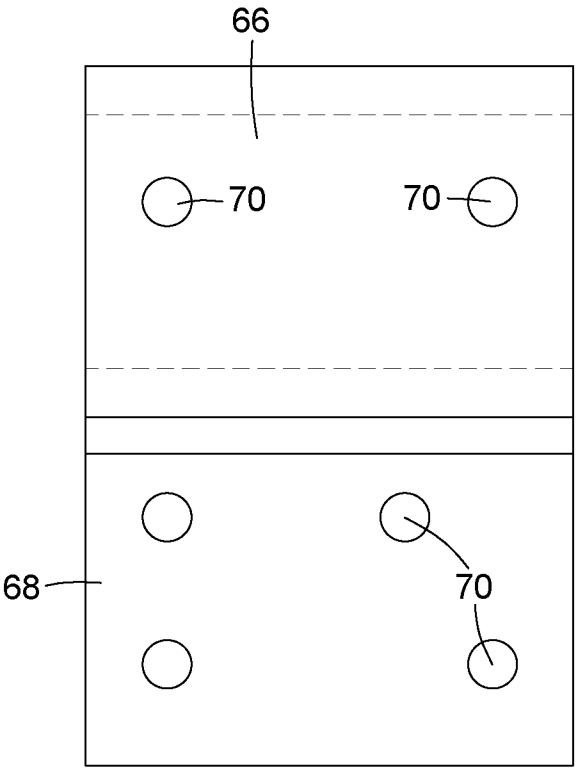
FIG. 22 is a front elevational view of a beam connector from FIG. 21.
Figure 21:
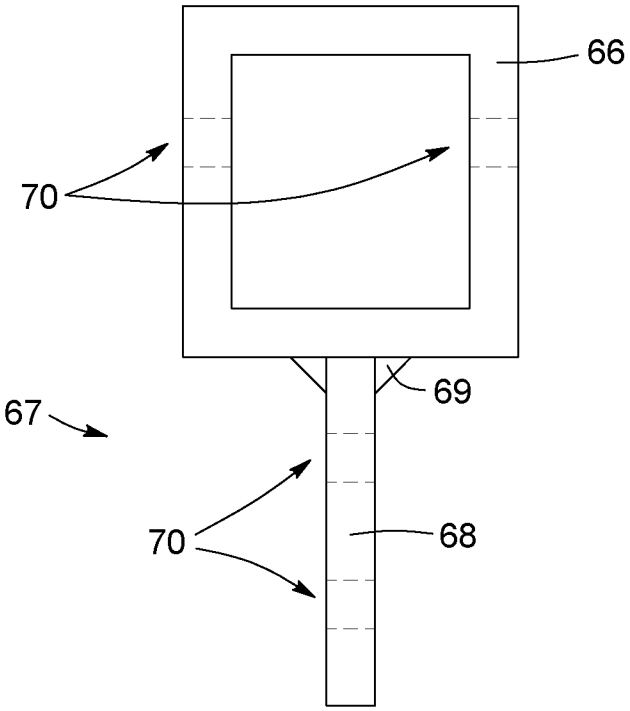
FIG. 21 is a front elevational view of a beam connector including a square-shaped sleeve for holding a longitudinally-extending flange of a composite I-truss according to an embodiment.

Referring to the particular embodiment of FIGS. 1 and 2, each one of the first flange 20 and the second flange 21 comprises two juxtaposed longitudinal beams 24*a* and 24*b*. The first and second flanges 20, 21 are spaced-apart from one another and lie in the same flange plane. A web portion 22 of the I-truss 16 is defined by the space between the two flanges 20, 21. At least a section of a web 23 extends in the web portion 22 of the I-truss 16. Amongst others, the web 23 includes flange connectors comprising, a first flange connector 26*a* and a second flange connector 26*b*, which are embodied here as a plurality of longitudinally spaced-apart members embodied here as fixation plates. The fixation plates 26 have a flange section (26*y*, 26*z*: FIGS. 2 & 3) extending and interposed between the two juxtaposed longitudinal beams 24 and a web section (26*a*, 26*b*) extending away from the respective one of the flanges in the web portion, and towards the other one of the flanges. Alternatively to fixation plates 26, the flange connectors can be embodied in other forms such as, for example, a U-shaped bracket (as shown in FIGS. 19, 20) or a closed sleeve such as shown in FIGS. 21, 22, that will be described in more details below.

Returning to FIG. 1, the pair of beams 24*a*, 24*b* are juxtaposed with the fixation plates 26 extending inbetween. The beams 24 can vary in size and, alternatively, each one of the beams 24 can be constituted of one integral piece or several laminated layers. The beams can be made of wood, graphite, or other suitable materials or polymers including plastics for example, having properties enabling proper support. In some embodiments, the beams can be partly made of plastic materials such as high density polyethylene (HDPE), polyvinyl chloride (PVC), low density polyethylene (LDPE), polypropylene, polystyrene or other materials of the like, including combination thereof, provided the beams are having suitable mechanical properties. For instance, the Perma-Deck™ beams, manufactured by Cascades inc. (Quebec, Canada), can be used as longitudinal beams 24.

In one particular embodiment, each one of the beams 24 can be made of a unitary wood piece of length, height and width of a wide variety. For example, the height and width may be ranging from one inch to 36 inches, and more commonly range around 10" by 10" as often used by a person skilled in the art. In one embodiment, the wood can be, without being limited to, fir, pine, spruce, larch, ash tree, walnut, maple, hemlock or poplar. In a particular embodiment, the wood is larch. In a further particular embodiment, the wood is Douglas fir-larch of category No. 1. In one embodiment, the beams 24 can be constituted of a plurality of wood layers secured together by conventional means such as with nails, screws, glue or the like. In another embodiment, the beams can be constituted of an integral piece, such as without being limitative a sole piece of wood. In a further embodiment, beams 24 can be treated or coated so as to enhance their weather resistance. In another embodiment, beams 24 can be treated or coated with a fire retardant for fireproofing. Given beams 24 constituting a same composite I-truss or flange do not have to be of the same nature.

The flange connectors 26 can vary in size and shape provided that it features a sufficiently big surface for being mounted onto the beams 24 with the web section 26*a*, 26*b* protruding therefrom. As mentioned above, in one embodiment, the flange connector includes one or more fixation plates 26 that can be made of metal, such as aluminum, steel, iron or alloys thereof. In one particular embodiment, the fixation plate 26 is made of aluminum. In a further particular embodiment, the fixation plate 26 is made of a 6061-T6 aluminum alloy. Particularly, the fixation plates 26 may be mounted at a plurality of longitudinal positions along the flanges 20, 21.

The beams 24 can be connected to each other and secured to the flange section 26*a*, 26*b* of the flange connectors, such as the fixation plates 26, by means of flange fastening assemblies which can include mechanical fasteners such as bolts and nuts, or mortise and tenon joints. The flange fastening assemblies can also include at least one shear ring 76 to further hold the elements together (see also FIGS. 25-28). In one embodiment, the mechanical fasteners, such as the structural bolts, can be made of galvanized steel. Such an embodiment facilitates the maintenance of the composite I-truss 16 and structures made thereof, avoiding welding that would otherwise significantly weaken the structure. In a further embodiment, the beams 24 can be grooved to better allow docking of the fixation plates 26 and the shear ring(s) 76, if any.

The flange connectors comprise fixation plates 26 made of a flange section (26*y*, 26*z*) securable to the flanges 20, 21 and a web section (26*a*, 26*b*) protruding outwardly from the flanges towards the web portion 22. The flange sections 26*a*, 26*b* of the flange connectors comprise a fixation body having at least one flange-facing surface to which the beam is juxtaposed for securing with the fastening assemblies and a web section for fastening the connecting elements 28.

In particular embodiments, the flange section 26*y*, 26*z* of the flange connectors can take several configurations, such as, for example a plate, an L-shaped body, a T-shaped body, a U-shaped channel or a closed sleeve (as shown in FIGS. 19-23). In particular non-limitative embodiments, the fastening assemblies can further include at least one bolt 80 (see FIGS. 5, 6 and 26) extending outwardly from the beam-facing surface of the fixation plate, L-shaped fixation member or T-shaped fixation member 26. The bolt 80 can be integral with its respective beam-facing surface. For instance and without being limitative, the bolt 80 can be friction welded to the beam-facing surface of the plate, or L- or T-shaped fixation member 26. In another non-limitative embodiment, the bolt 80 can be extruded or molded simultaneously with its respective fixation plate/member 26. The bolt 80 can extend on one side of its respective fixation member 26 or on both sides thereof. One fixation member 26 can include one or a plurality of spaced-apart bolts 80, extending one side or both sides thereof. The cross-sectional size, shape and length of the bolt 80 can vary and be adapted to the application. The bolt 80 is then inserted in an aperture of the beams 24 for engagement of the fixation member 26 to the beam 24. A free end thereof can be threaded. Therefore, the bolt 80 (and thus the fixation member 26) can be secured to the beam by engaging an internally-threaded nut 32 or 39 to a respective one of the bolt 80.

Still referring to FIGS. 1 and 2, the web 23 comprises a plurality of connecting elements corresponding to linking struts 28 located at a plurality of longitudinal positions along the length of the flanges 20, 21 and forming a lattice connecting the second flange connectors 26*b* to the first flange connectors 26*a*. In one embodiment, the linking struts 28 can be normal or angled relative to the longitudinal axis of the flange. Particularly, the angled linking struts 28 can be diagonal relative to the flange. Still, particularly, the angled linking struts 28 can alternate with the normally-oriented struts 28 so as to form a web lattice 23 with linking struts 28 of varying or alternating orientations.

Particularly, the linking struts have the form of an elongated flat elements or they can have a L-shaped cross-section (shown in FIG. 13-14), have a quadrilateral (such as square, see FIGS. 15-16) or rounded cross-sections (see FIGS. 17-18), or any other shape insofar as it has enough resistance to support the weight carried by the composite I-truss. In one optional embodiment, the linking struts can be made of metal, such as and without being limitative aluminum or galvanized steel. In another embodiment, both the fixation plates 26 and the linking struts 28 can be full.

Referring to FIG. 3, two linking struts 28 can connect a same given side of a fixation plate 26, or they can be connected on either side of the fixation plate 26. In one embodiment, some linking struts 28 can vertically connect respective ones of the fixation plates 26 from the first 20 and second flanges 21 (i.e. normally extending respective to the length of the flange), and some linking struts 28 can diagonally extend and connect alternating ones of the fixation plates 26 from the first 20 and second flanges 21. The diagonally-extending strut define an oblique angle, and define any angle that is not normal (90°) or flat (180°), not necessarily a 45° angle. Also shown are bolts and nuts (38 or 39) used to fasten the flange 20, 21 to the fixation plates 26, and/or to fasten the linking struts 28 to the fixation plates 26.

Referring back to FIG. 1, there is shown a particular embodiment where each flange comprises a pair of beams juxtaposed lenghtwise and secured together by fixation plates 26. Some of the linking trusts 28 diagonally connect one fixation plate 26 from the first flange 20 to the next longitudinal position fixation plate 26 of the second flange 21. The pattern of diagonally-oriented struts can be separated in two sections (right and left) starting at a longitudinal midpoint of the I-truss 16 by a vertical strut 28*a*. On each side of the midpoint strut 28*a*, the linking struts 28 can be alternating between a normal strut (i.e. 90° angle) and a diagonal strut, positioned in opposite directions from the midpoint of the I-truss 16 (i.e. mirror image on both sides of the center strut 28*a*).

Figure 4:
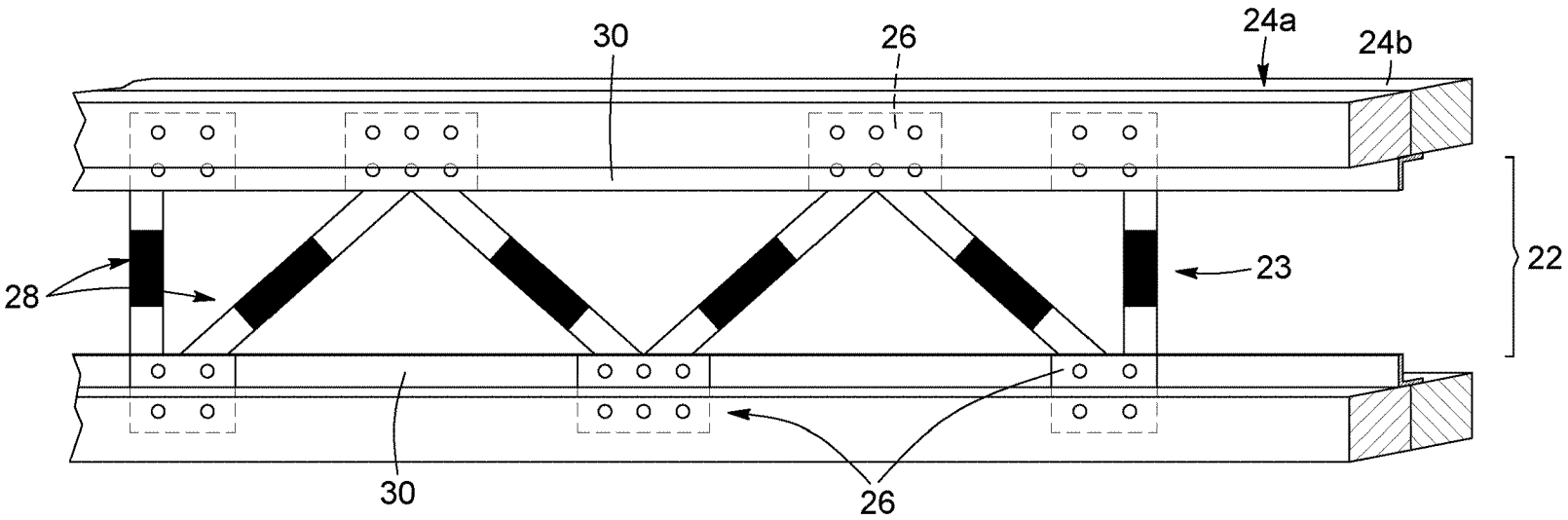
FIG. 4 is a perspective view of a composite I-truss according to another embodiment.

Alternatively, as shown in FIG. 4, the diagonal linking struts 28 can be alternatively positioned at regular or similar angles from one another that define a zigzag pattern between the first and the second flanges. Of course, a person skilled in the art will recognize that the pattern of linking struts and their angle with respect to the longitudinal flanges is required for structural strength purposes according to well established structural engineering principles, and may additionally be arranged for decorative purposes.

Still, referring to FIG. 4, the flange connector 16 can further include one or more longitudinal mounting elements such as L-shaped bars 30 connecting the fixation plates 26 and the linking struts 28. Such an embodiment can facilitate the assembly of the composite I-truss 16 by allowing pre-assembled sections of a web lattice 23, containing linking struts 28, connected by one or more mounting elements 30, to be mounted on the fixation plates 26 at desired positions. In one embodiment, the mounting elements 30 can be made of metal, such as steel or aluminum.

Figure 5:
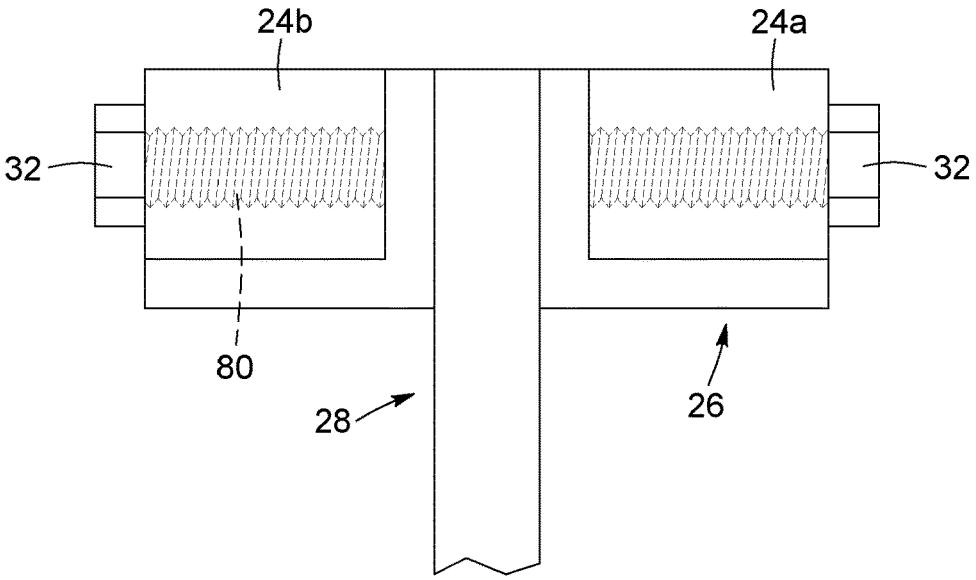
FIG. 5 is a sectional view of an upper section of a composite I-beam according to another embodiment.
Figure 6:
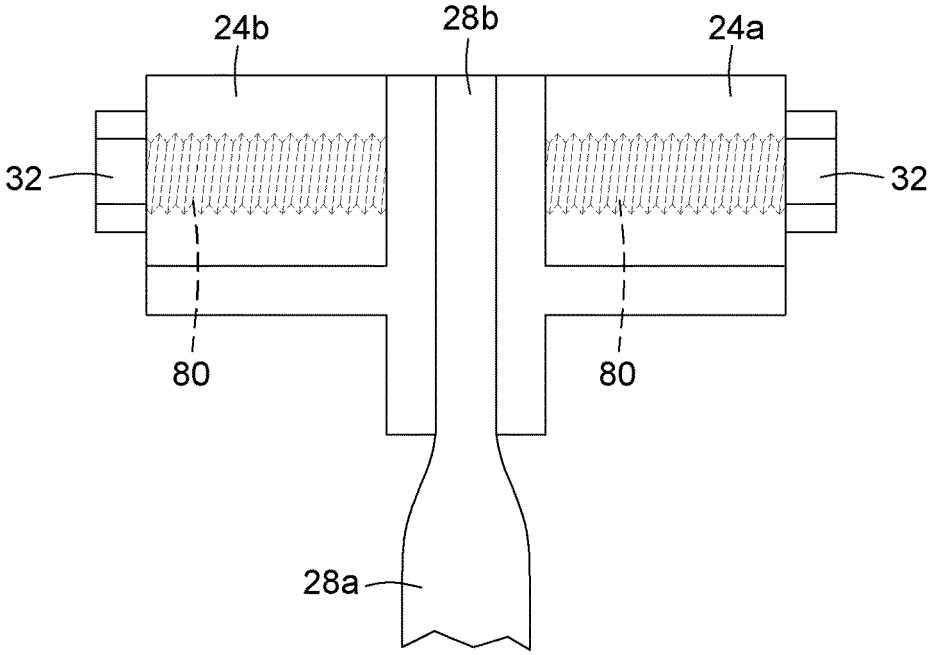
FIG. 6 is sectional view of an alternative embodiment of the upper section of the beam connector fastened to a flattened linking strut.

Referring to FIG. 5, a plurality of fixation plates 26 can be mounted to the beams 24 at a same longitudinal position. In one particular embodiment, two fixation plates 26 can be mounted on either side of an end of a linking strut 28. In one particular embodiment, the fixation plates 26 are L-shaped plates so that beams 24*a*, 24*b* partly or wholly sit on them. Each end of the linking struts 28 extends between the two L-shaped fixation plates 26. In another particular embodiment (FIG. 6), the fixation plates 26 can be T-shaped to have an improved contact surface with the linking struts 28. Alternatively, as shown in FIG. 6, the linking strut's end 28*b* can be flat to allow easier fastening of the assembly "plate 24*a*-strut 28-plate 24*b*".

Figure 7:
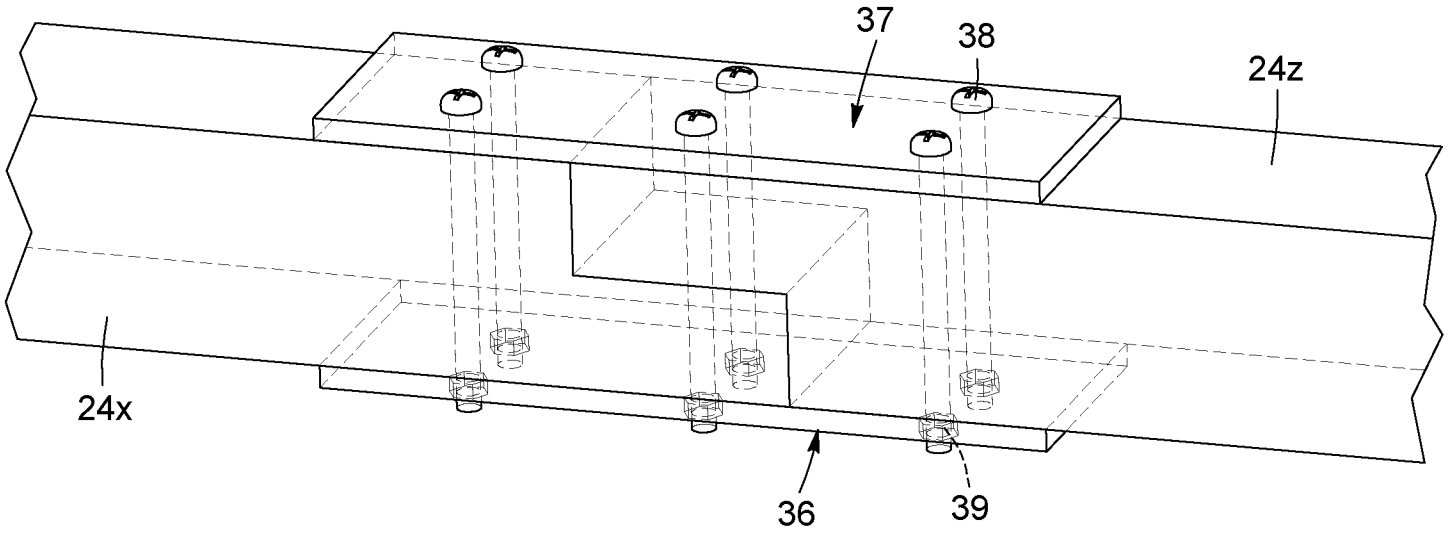
FIG. 7 is a perspective view of connected beams providing a method for elongating the composite I-truss, according to an embodiment.

Referring to FIG. 7, in another aspect, there is provided a method of elongating the composite I-truss 16, whereby two or more beam sections 24*x*, 24*z* are connected at their distal ends. In one embodiment, the beam sections 24*x*, 24*z* are connected at their complementarily shaped distal ends (i.e. head-to-tail). In one embodiment, the two or more beam sections 24*x*, 24*z* can be connected at their distal ends by longitudinally cutting a top section from one beam section 24*z*, longitudinally cutting a bottom section of the other beam section 24*x*, superimposing the beam sections at their cut sections and attaching the beam sections 24*x*, 24*z* to joining members 36, 37 located on opposed first and second sides of the beams 24, as shown in FIG. 7. Both joining members, embodied herein as plates 36, 37 cover the two beam sections 24*x*, 24*z* meant to be attached thereby. In one embodiment, the joining plates 36, 37 can be made of metal, such as and without being limitative aluminum. The joining plates 36, 37 can be mounted to the beam sections 24*x*, 24*z* by means of bolts 38 and nuts 39 or other connecting means known of the person skilled in the art. In one embodiment, more than two joining plates 36, 37 can be used for connecting given beam sections 24*x*, 24*z* at their distal ends. In another embodiment, the two or more joining plates 36, 37 can be connected together and form thereby a sole joining member covering at least partially an end section of the two beam sections 24*x*, 24*z*. In particular embodiments, the sole joining member can be U-shaped, or can enclose the whole periphery of the beam sections 24*x*, 24*z* (such as a U-shaped channel: FIG. 19 or a sleeve: FIG. 21). In another embodiment, the plurality of beam sections 24*x*, 24*z* can be further connected simply at their respective 90°-cut ends, or by finger jointing.

This method of elongating the composite I-truss 16 may provide a practical solution to the problem that is that beams or flanges oftentimes bend and twist. Using small sections of beams 24 can therefore allow the use of shorter straighter pieces of wood, for example, which are relatively cheap and readily available. Moreover, long wooden pieces can be difficult to find or more expensive in certain regions due to the relative shortness of the trees growing in those regions.

In another aspect, there is provided a use of the composite I-truss 16 as a supporting truss for a structure. In one embodiment, the supporting truss can be longitudinal to the structure. In another embodiment, the supporting truss can be transversal to the structure. In another embodiment, the supporting truss can be affixed to vertical beams described below and serve as diagonal truss for strengthening a structure. In one embodiment, the supporting truss can be used as horizontal, vertical or diagonal truss for bridges, platforms or other structures or buildings. In a further embodiment, a plurality of composite I-trusses 16 can be used as supporting trusses for a given structure. In a particular embodiment, the composite I-truss 16 can be used as a supporting truss for short or medium span bridges. The expression "short or medium span bridges" refers to bridges around or below roughly 100 feet in length. The composite I-truss 16 can be thereby used alone or in conjunction with other supporting trusses or beams known in the field.

Figure 8:
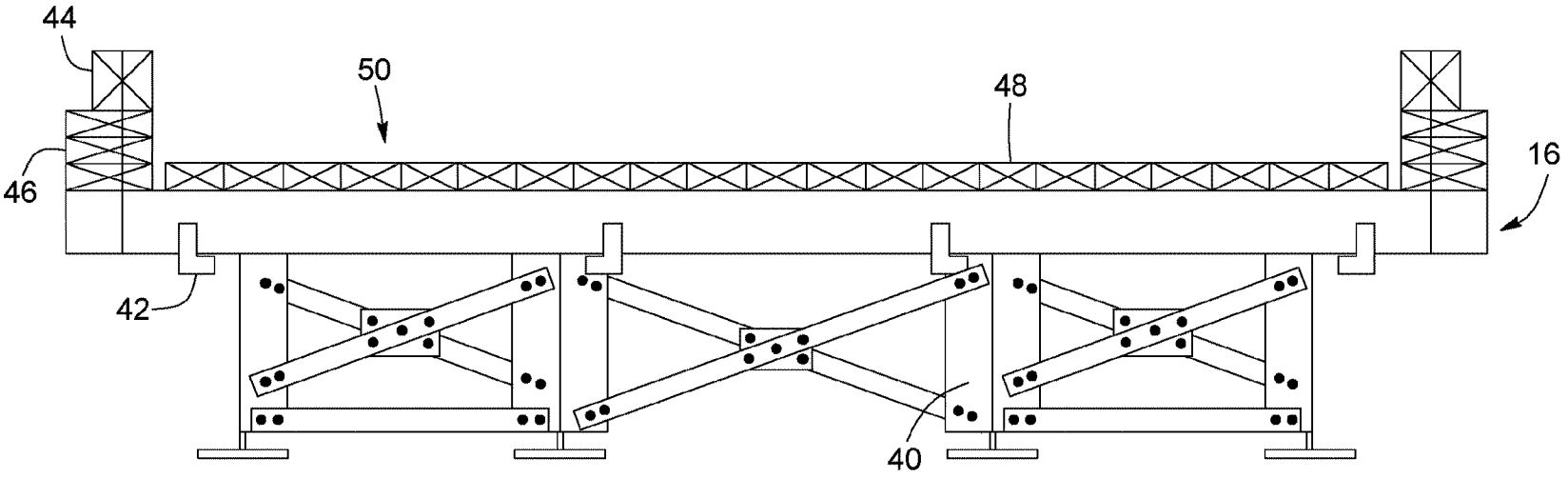
FIG. 8 is a side elevation view of a bridge comprising the composite I-truss according to an embodiment.

Referring to FIG. 8, the composite I-truss 16 when positioned horizontally can be a transversal truss for a bridge 50 and can be supported and connected to vertical beams 40 by assembling elements 42. The vertical beams 40 can vary in number and shape. In one embodiment, the assembling elements 42 can be L-shaped members. In one embodiment, the assembling elements 42 can be made of metal, such as, and without being limitative, aluminum. In one embodiment, the bridge 50 can further include a tread 48 covering the composite I-truss 16. The tread 48 forms a rather flat platform and thereby allows any person or vehicle to cross the bridge 50. In one embodiment, the bridge 50 can further include guard fences 44 located on both side-ends of the bridge 50. The guard fences 44 constitute a wall for preventing persons or vehicles crossing the bridge 50 from falling thereof. In one embodiment, the guard fences 44 can be supported by guard fence supports 46. In one embodiment, both the guard fences 44 and guard fence supports 46 can be mounted to the composite I-beam 16 by conventional mounting means such as bolts or the like. In a further embodiment, the guard fence supports 46 can cover the whole side-ends of the bridge 50 vertically delimited by the guard fence 44 and the tread 48 and thus reducing risks of falling thereof. In one embodiment, the vertical beams 40, the tread 48, the guard fences 44 and the guard fence supports 46 can be made of wood, concrete, metal, plastic or other materials known in the field. In another embodiment, the tread 48 can be made of asphalt.

Figure 9:
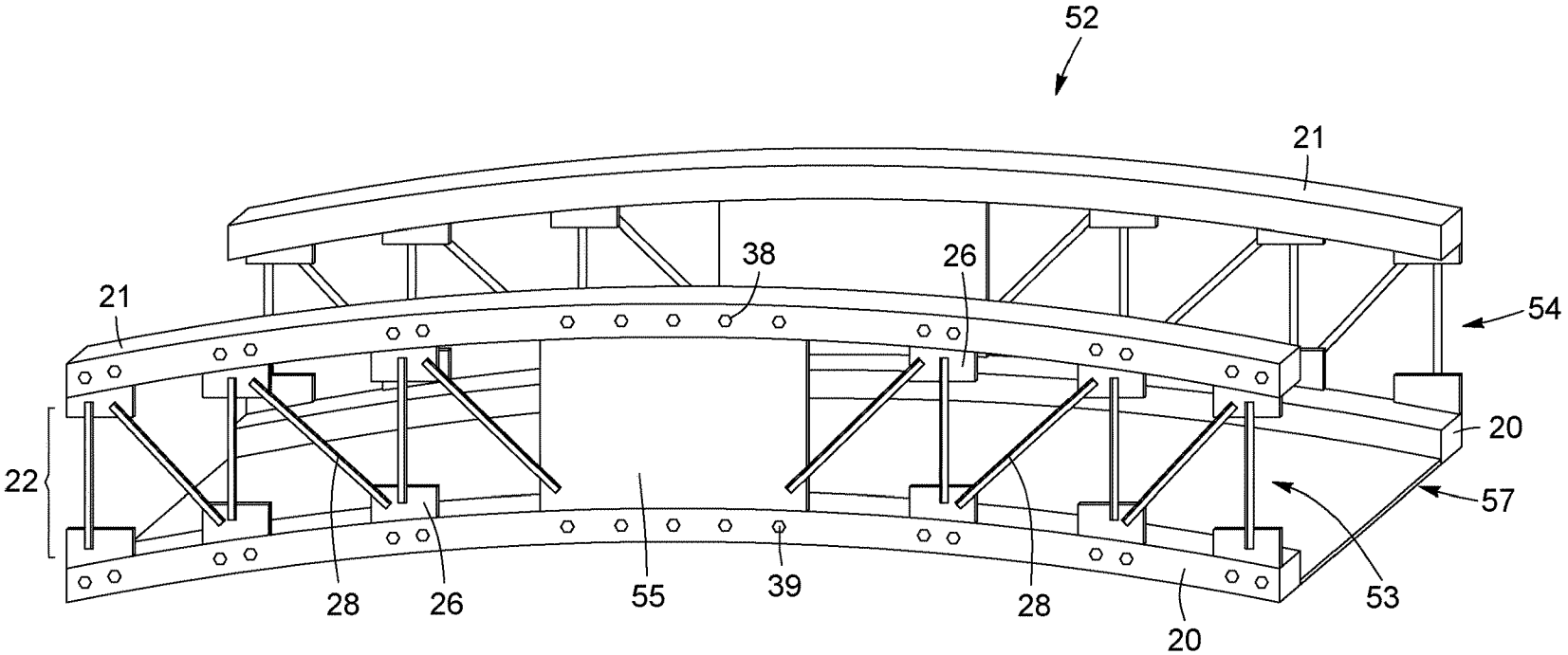
FIG. 9 is a perspective view of two curved composite I-trusses juxtaposed to form a pedestrian bridge according to an embodiment.

Referring to FIG. 9, there is shown a pedestrian bridge 52 built from a pair of spaced apart curved I-trusses 53, 54. Also provided is a centrally positioned plate 55 that acts as a linking strut 28 to strengthen the I-truss. This plate 55 can also act as an insigna support for advertisement purposes, and as flange connector 26 secured to the first 20 and second 21 flanges by fastening assemblies such as for example, bolts and nuts. Each curved flange can be made of a unitary curved beam, made of wood, metal or any other suitable material, or the beam can be made of two curved beams juxtaposed side-by-side and secured to each other by fixation plates such as the ones described in FIG. 1. In another embodiment, each curved flange can be made of laminated wood layers, held together by U-shaped brackets (see FIGS. 16 and 18) or by sleeves (see FIG. 17). In this particular embodiment, each I-truss 16 is placed on a side of a platform 57 that is secured at, or near, the first flanges 20 to act as a bridge and allow passage of pedestrian. Each second flange 21 and its the web 22 can also act as a side handrail (or guard fence).

Figure 10:
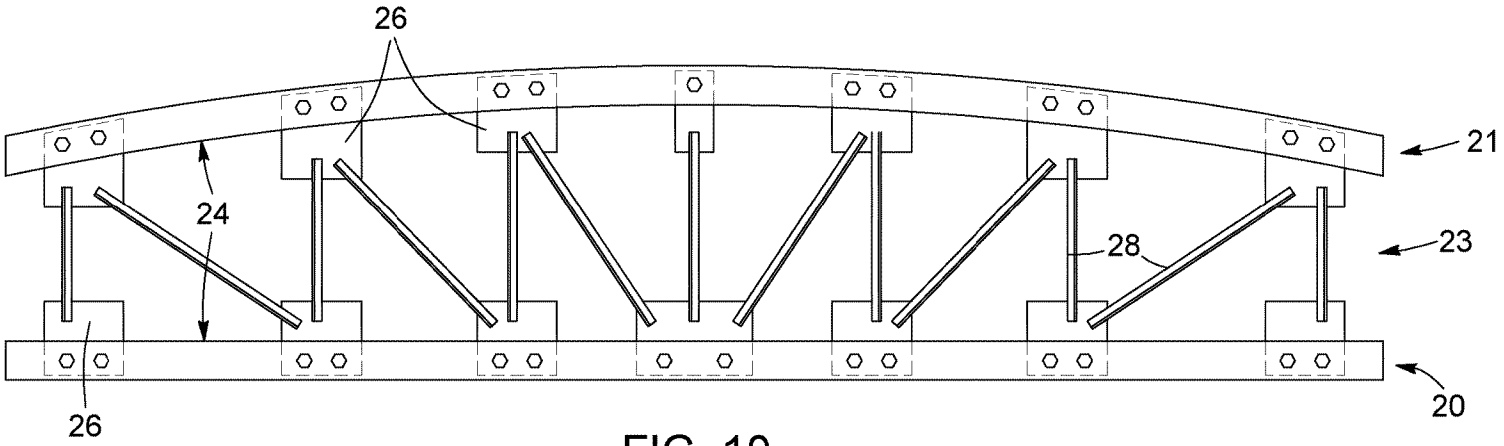
FIG. 10 is a front elevational view of a semi-curved composite I-trusses for a pedestrian bridge according to another embodiment.
Figure 11:
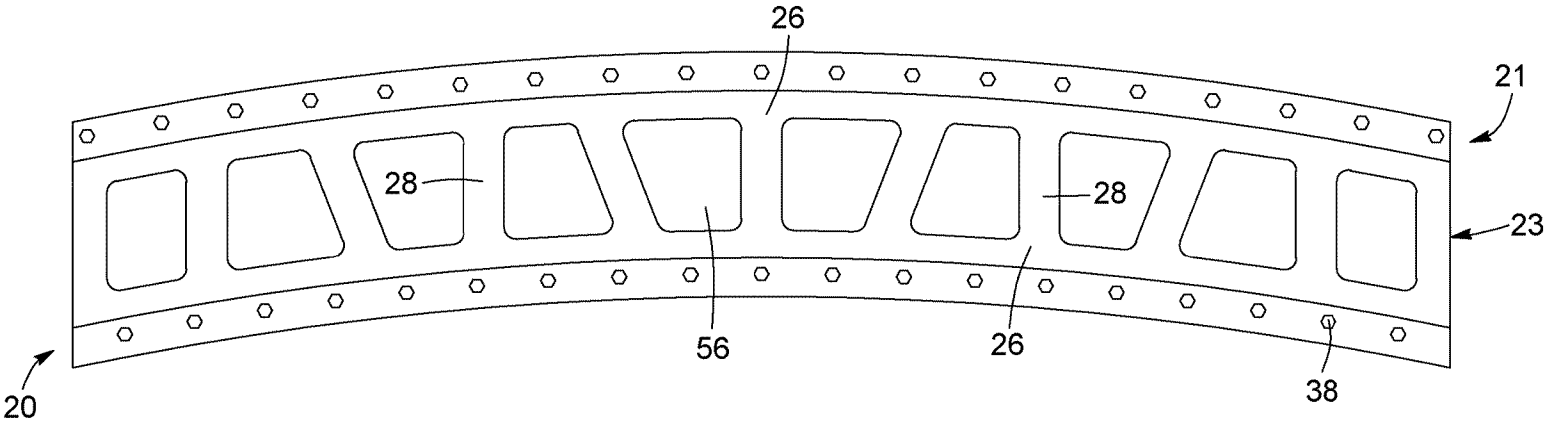
FIG. 11 is a front elevation view of a pair of curved composite I-trusses for a pedestrian bridge according to an alternative embodiment where the web is constructed as a single piece.

FIG. 10 shows an alternative embodiment of the I-truss of the invention that can be used as a pedestrian bridge where the first flange 20 is straight and the second flange 21 is curved, whereas FIG. 11 shows an alternative embodiment of the I-truss of the invention that can also be used as a pedestrian bridge with two curved flanges (first 20 and second 21) but where the web lattice 23 is built out of a unitary steel plate. The plate is machined to produce openings 56, the metal therebetween forming the web lattice 23 made of connecting elements 28 and flange connectors 26. Alternatively, the unitary web lattice 23 can be made out of steel plates or connecting elements 28 securely welded to flange connectors 26. This unitary web lattice 23 can be fastened to each flange 20, 21 by way of well-defined fasteners 38, 39 already described, or fastening assemblies such as those shown in FIGS. 18, 23-34.

Figure 12:
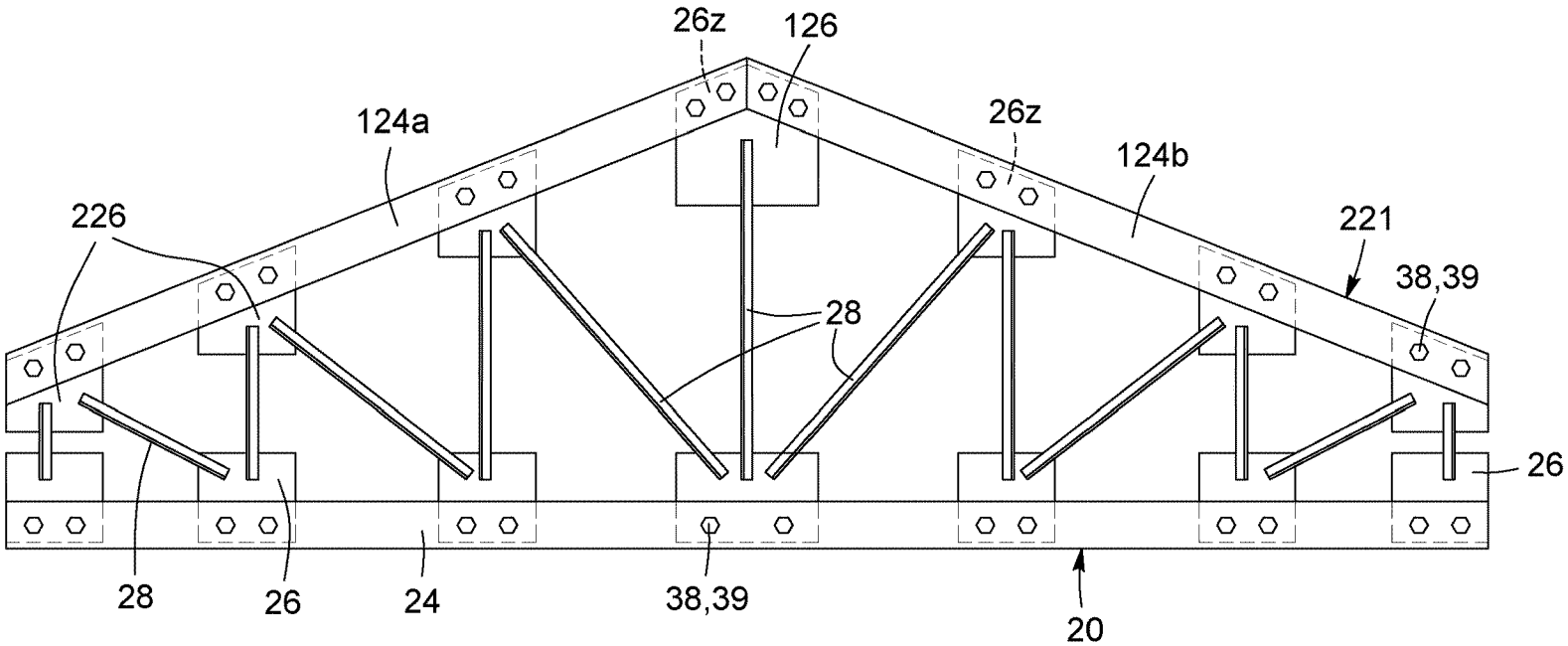
FIG. 12 is a front elevational view of a composite I-truss conceived to be used as a roofing truss according to an alternative embodiment.

Turning now to FIG. 12, there is shown a roofing truss made with the elements of the invention and according to the method defined herein where the second flange 221 is angled to define a centered apex and the first flange 20 is straight. In short, the second flange 221 is made of at least two beams 124*a*, 124*b* connected lengthwise and fastened at a defined angle by a flange connector 126, the flange section of which allowing fixation of the two beams 124*a*, 124*b* at an angle thereof. Alternatively, the upper side of the flange section (26*z*) of the central flange connector 126 defines an apex of the same angle as the one required for the beams 124*a*, 124*b*. As well, the upper side of the flange section (26*z*) of the left-side and right-side flange connectors 226 are angled to conform to the desired slope of the second flange 221.

Once again, the straight first flange 20 can be made of a single longitudinal beam, a pair of beams juxtaposed side-by-side or aligned "head-to-tail" and fastened together, or a laminated beam made of a plurality of layers, laminated together by means well known in the art.

Figure 14:
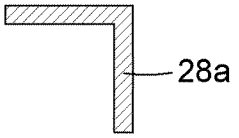
FIG. 14 is a cross-section view of L-shaped configuration of the linking struts from FIG. 13.
Figure 16:
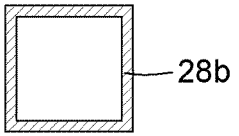
FIG. 16 is a cross-section view of a square cross-section configuration of the linking struts from FIG. 15.
Figure 18:
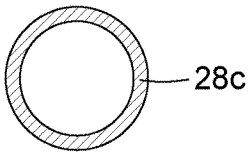
FIG. 18 is a cross-section view of a round-cross-section configuration of the linking struts from FIG. 17.
Figure 13:
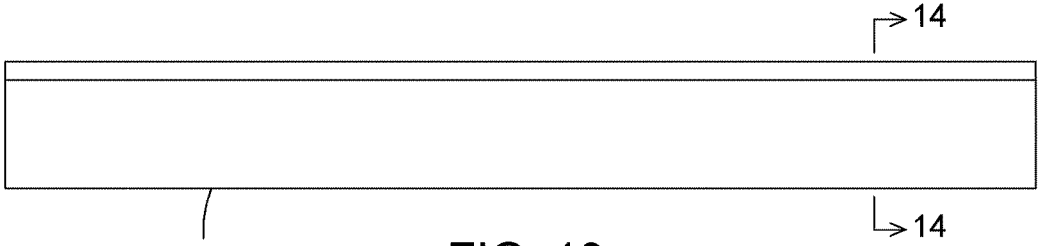
FIG. 13 is a side elevation view of L-shaped configuration of the linking struts according to an alternative embodiment.
Figure 15:
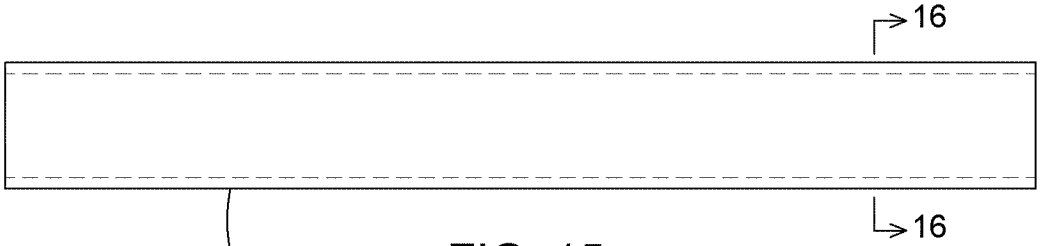
FIG. 15 is a side elevation view of a square cross-section configuration of the linking struts according to an alternative embodiment.
Figure 17:
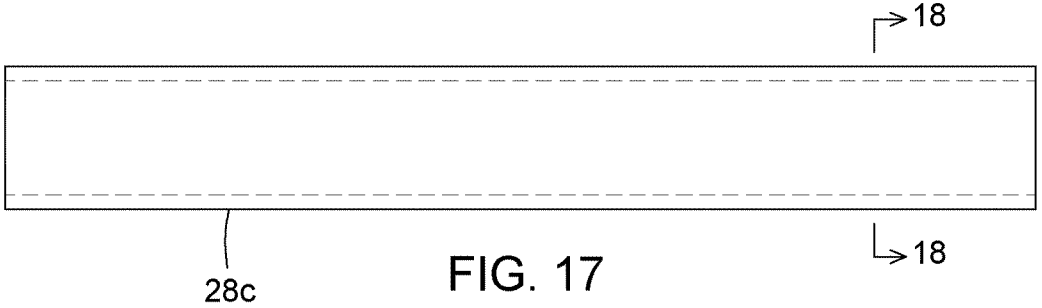
FIG. 17 is a side elevation view of a round-cross-section configuration of the linking struts according to an alternative embodiment.

In this embodiment, the connecting elements 28 are made of steel or aluminum and can take several forms such as, an L-shaped profile as shown in FIGS. 13, 14, a closed quadrilateral-shaped profile (such as square or rectangular) as in FIGS. 15, 16, or a closed rounded-shaped profile (round or ellipse) as shown in FIGS. 17, 18. Particularly, the closed profiles can be full or empty, but preferably empty to lighten the load. Particularly, in the case of square- or round-shaped profile, each end can be flattened to ease fixation to the flange connectors 26, 126 and/or 226 (see FIG. 6).

Turning now to FIGS. 19 & 20, there are shown the front elevation view (FIG. 19) and the side elevation view (FIG. 20) of U-shaped bracket 59 according to a particular embodiment of the flange connector 26 of the invention. FIG. 19 particularly shows the U-shaped channel 60 that is adapted to engage and support the beam(s) 24, and the web portion plate 62 (welded 64 or bolted to the bracket portion) for connecting to the connecting elements 28. The channel 60 and plate 62 each comprise at least one aperture for allowing fastening and tightening of the beam 24 by fastening assemblies such as bolts and nuts.

FIGS. 21 & 22 now show another embodiment of a flange connector in the shape of a square sleeve 67 for receiving one or more beams 24. In particular, FIG. 21 shows the front elevation view of the sleeve portion 66 adapted to receive the beam, and its web portion plate 68 (welded 69 or bolted thereto) adapted for connecting to at least one linking strut 28. FIG. 22 shows details of the apertures 70 adapted to receive the fastening assemblies for securing the beam(s) to the sleeve and apertures for fastening the connecting element 28 to the plate 68.

Figure 24:
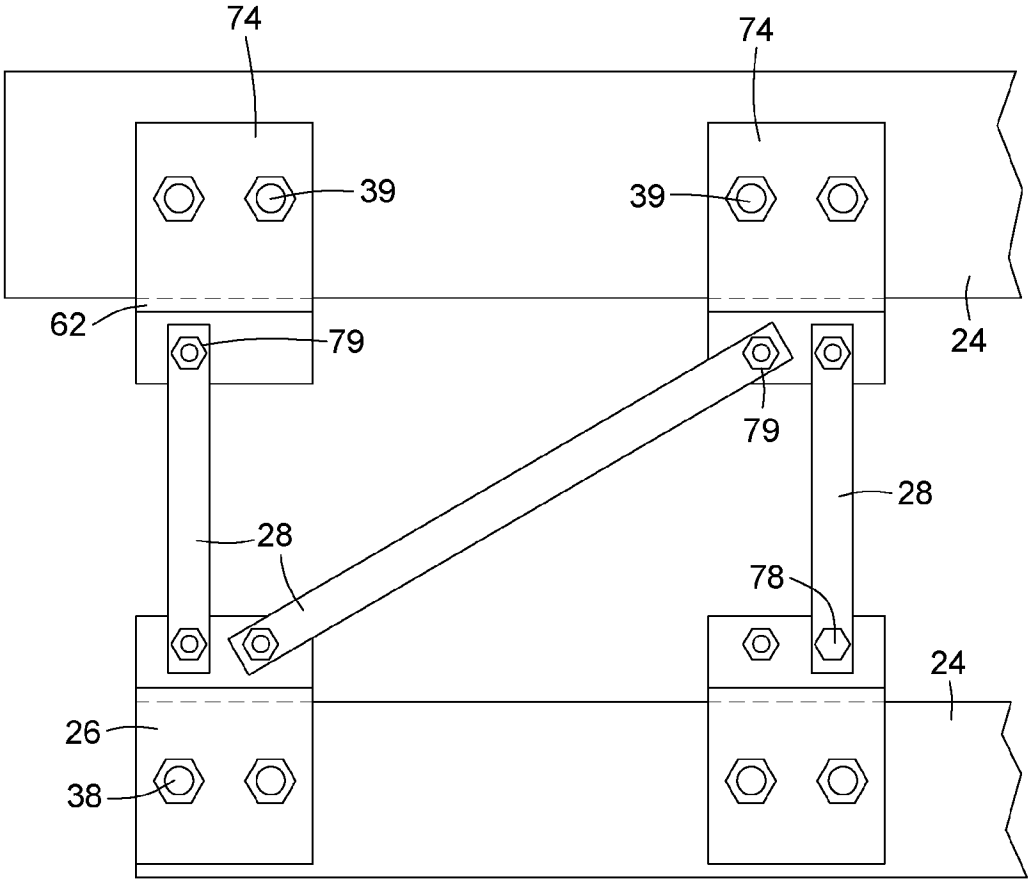
FIG. 24 is an enlarged front elevational view, of a composite I-truss built with flange connectors including first and second U-shaped brackets from FIG. 22.
Figure 23:
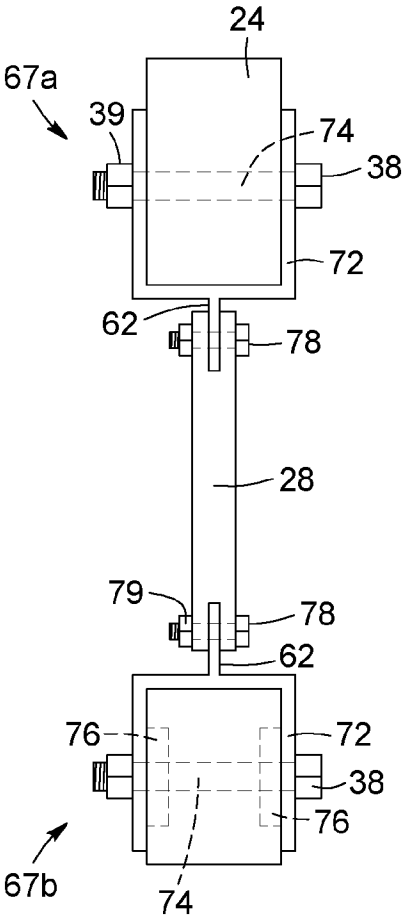
FIG. 23 is a side elevation view, of a composite I-truss built with flange connectors including first and second U-shaped brackets according to an embodiment.

FIG. 23 shows a side elevation view and FIG. 24 shows a front elevation view of an I-truss assembly where the second 21 and first 20 flanges are secured in U-shaped brackets 67*a*, 67*b*. Particularly, the one or more beams 24 are inserted in the U-shaped channel 72 and secured thereto by at least one bolt 38 and nut 39. Particularly, in this embodiment, the beam 24 is previously provided with a transversal aperture into which an inner sleeve 74 is inserted. This inner sleeve 74 is adapted to receive the bolt 38 and provide more strength for heavy weight-bearing assemblies. Further details of the inner sleeve 74 and other means of strengthening the assembly will be described in FIGS. 29-34.

Returning to FIG. 24, there is shown a connecting element 28 connected to the web section 62 of the U-shaped bracket 67, again secured by fastening assemblies such as bolts 78 and nuts 79. Of particular note in FIG. 19, the U-shaped channel 72 and the web section 62 are provided with apertures 65, 70 to receive the fastening assemblies at appropriate positions.

Figure 26:
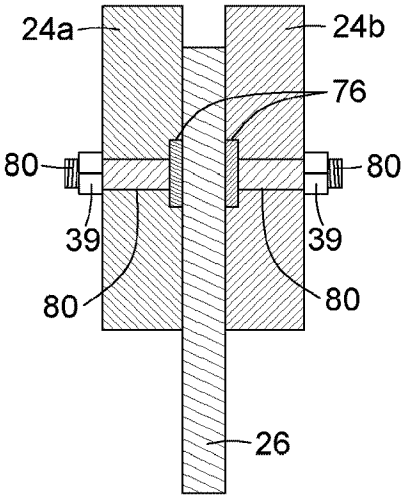
FIG. 26 is a sectional view of a different flange fastening assembly (inner shear rings) for the flange-forming pair of beams secured with a flange connector including a fixation plate according to an embodiment.

Turning now to FIGS. 25 to 28, there are shown different types of fastening assemblies to ensure maximal structural strength of the composite I-truss of the invention. FIG. 26 shows a fixation plate 26 having a bolt 80 extending from each flange-facing surface on each side of the plate. The bolt 80 on each side is then inserted in a respective aperture of the beam and secured therein by means of an inner shear ring 76 (and/or outer shear ring) before the assembly is finally secured with an external nut 39 on each side.

Figure 28:
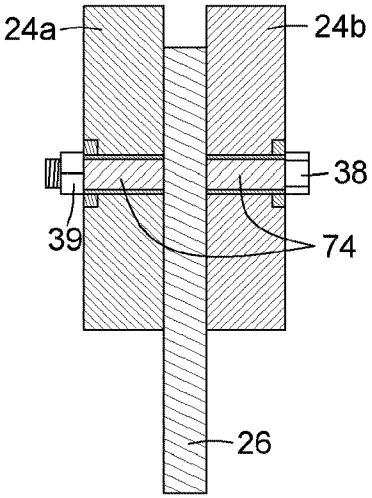
FIG. 28 is a sectional view of a different flange fastening assembly (bolt with sleeves and outer shear rings) for the flange-forming pair of beams secured with a flange connector including a fixation plate according to an embodiment.
Figure 27:
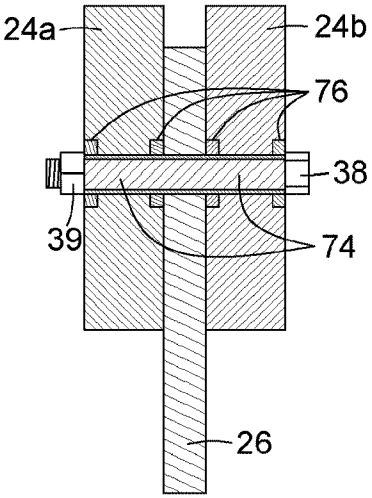
FIG. 27 is a sectional view of a different flange fastening assembly (inner and outer shear rings) for the flange-forming pair of beams secured with a flange connector including a fixation plate according to an embodiment.

Alternatively, FIGS. 27 and 28 show the assembly with the addition of an inner sleeve 74 being inserted between the bolt 38 and the beam 24. Alternatively, the sleeve 74 is inserted in an aperture made in the beam 24 prior to inserting the bolt 38 through the sleeved aperture. Alternatively, the bolt 80 and the sleeve 74 are integrally built on each side of the fixation plate 26. Still, alternatively, the bolt 80 is welded on each side of the fixation plate 26, and then the sleeve 74 is inserted over the bolt 80 and welded in place.

Figure 34:
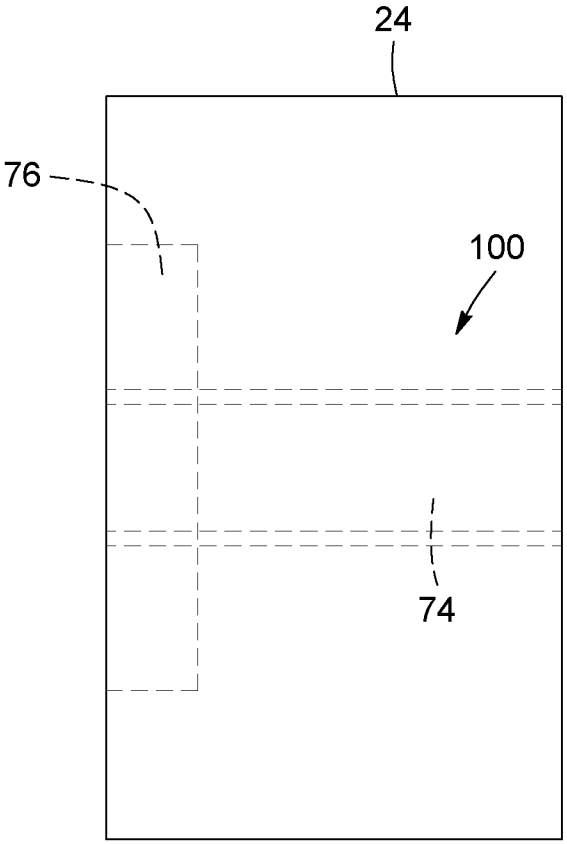
FIG. 34 is a side elevation view of a beam comprising the combination of shear ring and inner sleeve from FIG. 33 embedded therein.
Figure 33:
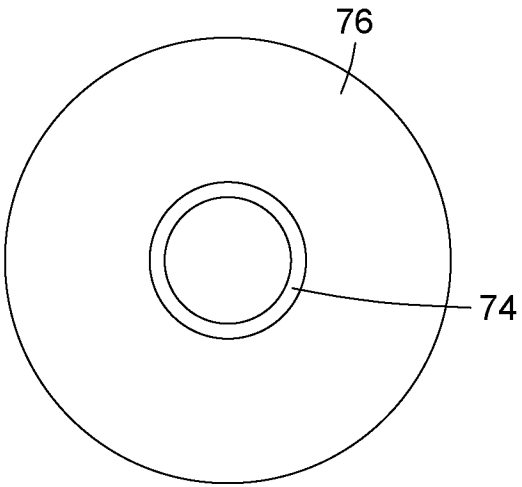
FIG. 33 is a front elevation view of the combination of shear ring and inner sleeve for the flange fastening assemblies for securing the flange to the flange connectors.

According to particular embodiment, both the sleeve 74 and shear rings 76 can also be built or welded together to form a one piece 100 combination (see FIGS. 33-34).

Figure 25:
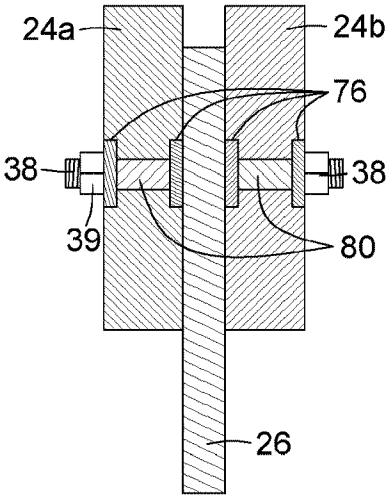
FIG. 25 is a sectional view of a different flange fastening assembly (bolt and sleeves with inner and outer shear rings) for the flange-forming pair of beams secured with a flange connector including a fixation plate according to an embodiment.
Figure 30:
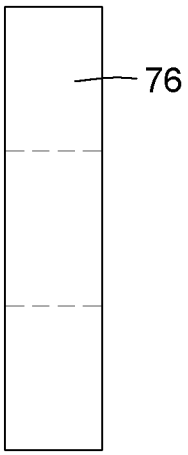
FIG. 30 is a side elevation view of the shear ring from FIG. 29.
Figure 29:
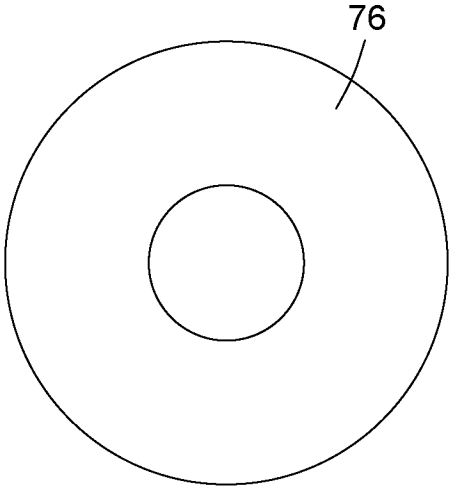
FIG. 29 is a front elevation view of the shear ring for the flange fastening assemblies for securing the flange to the flange connectors.
Figure 32:
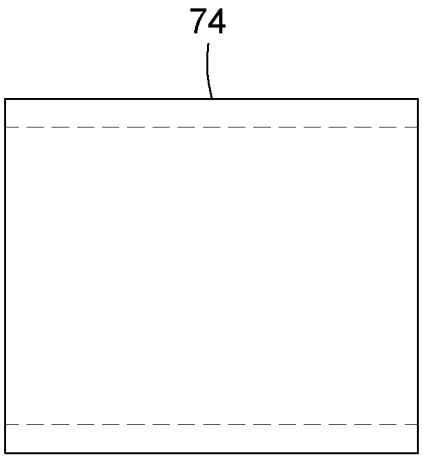
FIG. 32 is a side elevation view of the inner sleeve from FIG. 31.
Figure 31:
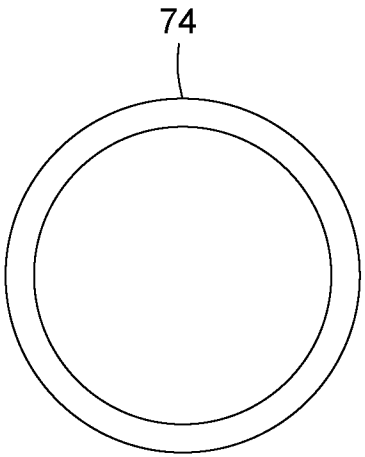
FIG. 31 is a front elevation view of the inner sleeve for the flange fastening assemblies for securing the flange to the flange connectors.

According to a particular embodiment, the beam 24 is fastened to the flange connector 26 with a bolt 38 that is inserted in the sleeve 74 and the bolt 38 is tightly secured with an intermediate shear ring 76 and an outside nut 39. Still, particularly, more than one shear ring 76 is provided, for example one inner (i.e. towards the fixation plate 26) and one outer (i.e. toward the outer surface of the wood beam 24). In fact, FIG. 27 shows a fastening assembly where two beams 24*a* and 24*b* are secured by a punctured fixation plate 26 by means of a bolt 38 extending through both beams 24 and the punctured plate 26 and exiting on the other side, passing through a single sleeve 74 extending on each side of the plate 26, two pairs of shear rings 76 positioned in a recess of the beam 24, and a nut 39 tightening the whole. Alternatively, FIG. 26 shows the assembly comprising two bolts 80 extending on each side of the plate 26, each bolt 80 inserted in openings of the beams 24, a pair of inner shear rings 76 and a nut 39 on the end of each bolt 80 for tightening the assembly. As well, FIG. 25 shows a bolt 38, inner and outer shear rings 76, and a nut 39 at the end of the bolt 38.

Finally, FIG. 28 embodies two sleeves 74 (integral or added to the fixation plate), a bolt 38 extending through both sleeves 74, a pair of outer shear rings 76 embedded in the wood beam 24, and a tightening nut 39.

As will be realized by the person skilled in the art, the shear ring may be embedded in the beam such that it does not protrude from the beam surface. For such a design, a person skilled in the art will drill a recess around the bolt aperture to allow embedding of the shear ring in the beam. Particularly, the recess is of the same depth as the thickness of the shear ring to avoid any protrusion thereof.

Of course, the person skilled in the art will understand that other combinations can be carried out such as, for example: with or without sleeve(s), one or two pairs of shear rings (inner and/or outer) and/or built-it threaded spindle with one nut at each end and/or an added bolt with one nut at one end. Finally, the person skilled in the art will realize that, in addition, rubber or Teflon® O-rings can be added to all such fastening assemblies to ensure water-repellence of the apertures and avoid premature internal rotting of the wood beams.

Finally, FIGS. 29 to 34 show details of different embodiments of the mechanical fasteners: a) shear ring 76, b) sleeve 74, and c) an integral sleeve and shear ring combination 100.

Method of Assembly

Having defined and discussed the individual components and features of some of the embodiments of the composite I-beam, the steps of a method for assembling the composite I-beam will now be described with reference to the accompanying figures.

Referring to FIG. 4, step a) involves mounting the connecting elements 28 to the fixation plates 26. FIG. 3 illustrates step b) of the method, which involves mounting the assembly of step a) to the beams 24. This mounting can be achieved by further using the mounting elements 30 (as shown in FIG. 4). FIG. 2 illustrates step c) of the method, which involves further mounting the two beams 24 altogether with the assembly of step a) by using conventional means such as bolts or other means discussed hereinabove, and reinforcing the assembly with shear rings.

Referring to FIG. 11, there is provided another embodiment of a method of mounting the assembly of the invention. Step a) provides the machining of a flat metal plate for providing apertures 56, the contours of which form connecting elements 28 and flange connectors 26, thus forming a web assembly. The web assembly is then connected to at least a pair of beams to form the I-truss assembly of the invention.

According to a particular embodiment, there is provided a method for assembling the composite I-truss described herein, comprising the steps of: a) mounting each respective end of the linking struts 28 along a length of a respective mounting element 30, forming a web subassembly 22; and b) mounting the web subassembly 22 of step a) to the flange connectors 26 to form a web assembly; and c) mounting the web assembly of step b) to the flanges 20, 21.

Kits

Moreover, it will be readily understood that the components of a composite I-truss 16 such as described above can be provided as a set or kit allowing installation of the assembly in a bridge or structure.

Such a set can include the connecting elements 28 and the fixation plates 26, which may or may not be preassembled, as well as other basic components of the composite I-truss 16 such as the beams 24, the mounting elements 30, the joining plates 36, 37 etc.

According to a further general aspect, there is provided a set or kit for assembling at least a pair of beams to form the I-truss described herein, comprising a plurality of connecting elements, and at a pair of flange connectors.

Such a kit can include a plurality of connecting elements 28, and at least a pair of flange connectors 26 selected from the group consisting of: fixation plates, L-shaped fixation members, T-shaped fixation members, U-shaped brackets and closed-sleeves, which may or may not be preassembled.

Particularly, there is provided the kit as defined above where the flange connectors and the linking struts are assembled to form a preassembled web.

According to a further general aspect, there is provided a set or kit for assembling a least a pair of beams to form the I-truss described herein, comprising a plurality of linking struts, at least one pair of mounting elements, and at least a pair of flange connectors selected from the group consisting of: fixation plates, U-shaped bracket and closed-sleeve; which may or may not be preassembled.

Particularly, there is provided the kit as defined above where the linking struts and the mounting elements are assembled to form a preassembled web subassembly.

Of course, numerous modifications could be made to the above-described embodiments without departing from the scope of the invention. It is appreciated that features of one of the above described embodiments can be combined with other embodiments or alternatives thereof.

The invention claimed is:

1. A composite I-truss comprising:

a first longitudinally-extending flange comprising at least two longitudinally-juxtaposed longitudinal beams;

a second longitudinally-extending flange spaced apart from, and extending in a same truss plane as the first longitudinally-extending flange and defining therebetween a web portion, the second longitudinally-extending flange comprising at least two longitudinally-juxtaposed longitudinal beams;

a web extending between and connecting the first longitudinally-extending flange and the second longitudinally-extending flange together, the web comprising a plurality of connecting elements, a first flange connector, a second flange connector, and a plurality of flange fastening assemblies, the first flange connector being secured to the first longitudinally-extending flange through a first set of the flange fastening assemblies extending through the first longitudinally-extending flange and the first flange connector, the second flange connector being secured to the second longitudinally-extending flange through a second set of the flange fastening assemblies extending through the second longitudinally-extending flange and the second flange connector, each one of the first and second flange connectors having a section protruding outwardly from a respective one of the first and second flanges in the web portion, the connecting elements being positioned longitudinally at a plurality of longitudinal positions along a length of the composite I-truss and having a first end secured to the first flange connector and a second end secured to the second flange connector, wherein the first and second longitudinally-extending flanges are made from a different material than a material of the first and second flange connectors and a material of the connecting elements of the web.

2. The I-truss according to claim 1, wherein each one of the at least two longitudinally-juxtaposed longitudinal beams of the first and the second longitudinally-extending flanges comprises a plurality of longitudinally adjacent beam sections, adjacent ones of the beam sections having complementary end sections superposed to one another; and joining members superposed to the superposed end sections of the adjacent ones of the beam sections and secured thereto.

3. The I-truss of claim 1, wherein each one of the at least two longitudinally-juxtaposed longitudinal beams of the first and the second longitudinally-extending flanges comprises a wooden beam; and the first and the second flange connectors and the connecting elements are made of metal.

4. The I-truss of claim 1, wherein each one of the first and the second flange connectors comprises a plurality of longitudinally spaced-apart flange connectors having: a flange section secured to a respective one of the first and second longitudinally-extending flanges and extending between the at least two longitudinally-juxtaposed longitudinal beams of a respective one of the first and second longitudinally-extending flanges; and a web section protruding outwardly from the respective one of the first and second longitudinally-extending flanges and secured to a respective one of the first and the second ends of the connecting elements, wherein the first and second ends of the connecting elements are secured to the web section of a corresponding one of the flange connectors.

5. The I-truss of claim 4, wherein the flange section of the plurality of flange connectors comprises one of: a fixation plate comprising a flat body and at least one beam-facing surface, a L-shaped fixation member comprising a L-shaped body comprising two beam-facing surfaces, a T-shaped fixation member comprising a T-shaped body and three beam-facing surfaces, the respective flange section of the one of the plurality of flange connectors interposed between the at least two longitudinally-juxtaposed longitudinal beams of a respective one of the first and second longitudinally-extending flanges.

6. The I-truss of claim 5, wherein the flange section of the plurality of flange connectors further comprises at least one bolt extending normally from the at least one beam-facing surface, the bolt being insertable in an aperture defined in a corresponding one of the first and second longitudinally-extending flanges.

7. The I-truss of claim 4, wherein each one of the plurality of connecting elements comprises a linking strut and the linking struts of the plurality of connecting elements comprise at least one normally-extending strut extending substantially normal to the first and second longitudinally-extending flanges, and at least one diagonally-extending strut defining an oblique angle with the first and second longitudinally-extending flanges, the at least one normally-extending strut and the at least one diagonally-extending strut being configured in an alternating configuration.

8. The I-truss according to claim 4, wherein each one of the first and second flange connectors further comprises a mounting element extending longitudinally along the respective one of the first and second longitudinally-extending flanges and being secured to the web section of the corresponding one of the flange connectors.

9. The I-truss of claim 4, wherein the flange section of the flange connectors comprises a plurality of apertures to receive a respective one of the fastening assemblies therein and the flange fastening assemblies comprise: bolts extending through a respective one of the first and the second longitudinally-extending flanges and a respective one of the first and the second flange connectors; and nuts engaged with the bolts, outwardly of the respective one of the first and the second longitudinally-extending flanges and the respective ones of the first and the second flange connectors.

10. The I-truss of claim 9, wherein the at least two longitudinally-juxtaposed longitudinal beams of the first and second longitudinally-extending flanges comprise recesses defined therein and the flange fastening assemblies further comprise shear rings inserted in the recesses, the shear rings surroundings a respective one of the bolts.

11. The I-truss of claim 9, wherein the flange fastening assemblies further comprise an inner sleeve inserted in the at least two longitudinally-juxtaposed longitudinal beams of a respective one of the first and the second longitudinally-extending flanges and surrounding a corresponding one of the bolts extending therethrough.

12. The I-truss of claim 11, wherein the fastening assemblies comprise an inner shear ring inserted in an inner side of a respective one the first and the second longitudinally-extending flanges, in a corresponding one of the at least two longitudinally-juxtaposed longitudinal beams, and an outer shear ring inserted in a respective one of an outer side of a respective one the first and the second longitudinally-extending flanges, in a corresponding one of the at least two longitudinally-juxtaposed longitudinal beams, wherein the inner and outer sheer rings surrounds a corresponding one of the bolts extending therethrough.

13. The I-truss of claim 12, wherein the sleeve is formed as a single piece with the shear ring.

14. The I-truss according to claim 1, wherein the first and the second flange connectors are formed as a single piece with the plurality of connecting elements of the web, with the connecting elements extending continuously between the first and the second flange connectors.

15. A bridge defining a passageway along a bridge axis and comprising: a plurality of composite I-trusses, each one of the composite I-trusses comprising:

a first longitudinally-extending flange comprising at least two longitudinally-juxtaposed longitudinal beams;

a second longitudinally-extending flange spaced apart from, and extending in a same truss plane as the first longitudinally-extending flange and defining therebetween a web portion, the second longitudinally-extending flange comprising at least two longitudinally-juxtaposed longitudinal beams;

a web extending between and connecting the first longitudinally-extending flange and the second longitudinally-extending flange together, the web comprising a plurality of connecting elements, a first flange connector, a second flange connector, and a plurality of flange fastening assemblies, the first flange connector being secured to the first longitudinally-extending flange through a first set of the flange fastening assemblies extending through the first longitudinally-extending flange and the first flange connector, the second flange connector being secured to the second longitudinally-extending flange through a second set of the flange fastening assemblies extending through the second longitudinally-extending flange and the second flange connector, each one of the first and second flange connectors having a section protruding outwardly from a respective one of the first and second flanges in the web portion, the connecting elements being positioned longitudinally at a plurality of longitudinal positions and having a first end secured to the first flange connector and a second end secured to the second flange connector, wherein the first and second longitudinally-extending flanges are made from a different material than a material of the first and second flange connectors and a material of the connecting elements of the web, wherein the plurality of I-trusses is positioned horizontally and perpendicular to the bridge axis.

16. A web kit for assembling a first longitudinally-extending flange and a second longitudinally-extending flange to form an I-truss, comprising:

a first flange connector having a flange section and a web section, the flange section being securable to the first longitudinally-extending flange with the web section protruding from the first longitudinally-extending flange;

a second flange connector having a flange section and a web section, the flange section being securable to the second longitudinally-extending flange with the web section protruding from the second longitudinally-extending flange;

a plurality of connecting elements, each one of the connecting elements having a first end securable to the web section of the first flange connector and a second end securable to the web section of the second flange connector; and a plurality of flange fastening assemblies for securing a respective one of the first and the second longitudinally-extending flanges to a respective one of the first and the second flange connectors and a plurality of flange fastening assemblies for securing an end of a respective one of the connecting element to a respective one of the first and the second flange connectors; and wherein the connecting elements comprise linking struts, and the first and the second flange connectors comprises at least one of: fixation plates, L-shaped members, and T-shaped members, wherein each one of the first and the second longitudinally-extending flanges comprises at least two longitudinally-juxtaposed longitudinal beams and the flange section of the first and second flange connectors is inserted between the at least two longitudinally-juxtaposed longitudinal beams of a respective one of the first and the second longitudinally-extending flanges.

17. The web kit for assembling the I-truss according to claim 16, wherein the connecting elements and the first and the second flange connectors are preassembled to define a web lattice.

18. The web kit of claim 16, wherein the web section of each one of the first and the second flange connectors further comprises a bolt secured to a flange-facing surface of the flange section of the first or the second flange connectors, the bolt protruding normally with respect to the flange-facing surface of the flange section.

* * * * *